US008471878B2

(12) United States Patent
Unger, IV et al.

(10) Patent No.: US 8,471,878 B2
(45) Date of Patent: Jun. 25, 2013

(54) SIGN MAKER TEMPLATES FOR PRODUCING CENTERED LABELS AND METHODS OF USE

(75) Inventors: George Francis Unger, IV, Anaheim, CA (US); Matthew Raymond Erickson, Anaheim, CA (US); Douglas J. Sproal, Anaheim, CA (US)

(73) Assignee: Cobra Systems, Inc., Anaheim, CA (US)

( * ) Notice: Subject to any disclaimer, the term of this patent is extended or adjusted under 35 U.S.C. 154(b) by 374 days.

(21) Appl. No.: 13/034,410

(22) Filed: Feb. 24, 2011

(65) Prior Publication Data

US 2012/0218365 A1 Aug. 30, 2012

(51) Int. Cl.
*B41J 2/325* (2006.01)

(52) U.S. Cl.
USPC ..... 347/171

(58) Field of Classification Search
USPC ..... 400/1, 3, 4, 5, 61; 358/1.1; 347/171
See application file for complete search history.

(56) References Cited

U.S. PATENT DOCUMENTS 4,881,834 A * 11/1989 Sato ..... 400/279
5,403,101 A * 4/1995 Nagase et al. ..... 400/3
5,967,675 A * 10/1999 Hastings et al. ..... 400/61
6,120,200 A * 9/2000 Watanabe et al. ..... 400/615.2
6,146,034 A * 11/2000 Watanabe et al. ..... 400/615.2
6,975,425 B1 * 12/2005 Abe et al. ..... 358/1.18

FOREIGN PATENT DOCUMENTS

JP 1-152070 * 6/1989
JP 5-305748 * 11/1993
JP 7-108716 * 4/1995

OTHER PUBLICATIONS

Lancer; "Mini Mark Portable Label Maker w/AC Power & Quick Charger," printed from www.lancerlabels.co.uk on May 24, 2011.
Brother; "P-Touch Edge Hand Held Labelers," printed from www.graphicproducts.com/labelers on May 24, 2011.
Brady; "HandiMark Handheld Labeler," printed from www.graphicproducts.com/labelers on May 24, 2011.
Brady; "GlobalMark 2 Label & Sign Printer," printed from www.graphicproducts/labelers on May 24, 2011.

* cited by examiner

*Primary Examiner* — Huan Tran
(74) *Attorney, Agent, or Firm* — Sheppard Mullin Richter & Hampton LLP

(57) ABSTRACT

The present invention provides a sign maker for printing signs and labels on a continuous roll of media without the use of a personal computer, the sign maker comprising: a keyboard for receiving user input; a printer for printing characters on the media; a cutter for cutting the media to a calculated length; and a user selectable template containing a centering algorithm stored on a non-transitory computer readable medium having computer executable program code embodied thereon, the computer executable program code configured to calculate a length of the media and center the printed characters on the media based upon the user input.

17 Claims, 4 Drawing Sheets

SIGN MAKER TEMPLATES FOR PRODUCING CENTERED LABELS AND METHODS OF USE

FIELD OF THE INVENTION

The present invention relates generally to signage, and more particularly to sign maker templates for producing centered labels and methods of use.

BACKGROUND OF THE INVENTION

Before automated sign makers, permanent adhesive labels and signs were created and printed by either a print/sign shop or by connecting a label printer to a personal computer that employed a design software application and printer drivers which are specific to the PC operating system. Print/sign shops are expensive, have long leads that can take three to ten business days, and often require large minimum orders. PC connected printer devices are difficult to use and have multiple software, firmware, and hardware points of failure. The only other portable standalone printing devices can print up to a maximum 2-inch wide labels and signs which cannot be used for many applications that require larger text, symbols, and sizing such as pipe marking and OSHA/ANSI safety signs.

BRIEF SUMMARY OF EMBODIMENTS OF THE INVENTION

The present invention is directed toward sign maker templates for producing centered labels and methods of use.

One embodiment of the invention comprises a sign maker for printing signs and labels on a continuous roll of media without the use of a personal computer, the sign maker comprising: a keyboard for receiving user input; a printer for printing characters on the media; a cutter for cutting the media to a calculated length; and a user selectable template containing a centering algorithm stored on a non-transitory computer readable medium having computer executable program code embodied thereon, the computer executable program code configured to calculate a length of the media and center the printed characters on the media based upon the user input.

In operation, the printer employs a thermal printer engine to transfer ink from a thermal transfer roll to the media, and wherein the media is cut using the cutter at the completion of the printing to produce a finished sign or label. In some implementations, the sign maker further comprises a portable battery pack for powering the sign maker. The sign maker has no boot/loading time such that it is ready to use immediately upon being turned on.

In some embodiments, the user input includes a desired template selected from the group consisting of: a horizontal template, a vertical template, a header template, an arc flash template, a wire wrap template, a barcode template, and a pipe marking template. User input may also include a media width, a number of lines of characters, a sequence of characters for each line, and a quantity of signs or labels to print. The printed characters are centered justified and cut proportionally on the finished sign or label. The length of the cut media is calculated based upon a pixel width of a longest line of characters. In certain embodiments, the keyboard includes an LCD screen for users to view a selection of available templates and user inputted text.

A further embodiment of the invention comprises a user selectable template containing a centering algorithm stored on a non-transitory computer readable medium having computer executable program code embodied thereon, the computer executable program code configured to receive user input from a keyboard and control the operation of a printer and a cutter without the use of a personal computer, by performing the steps of: receiving user input from the keyboard including a desired template, a media width, a number of lines of characters, a sequence of characters for each line, and a quantity of signs or labels to print; calculating a length of the media based upon a pixel width of a longest line of characters; controlling the printer to print the characters on the media according sequence of characters inputted by the user; and controlling the cutter to cut the media to the calculated length.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention.

These figures are not intended to be exhaustive or to limit the invention the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

The present invention is directed toward systems and computer products for implementing a sign maker using a series of user selectable templates. According to some embodiments of the invention, the sign maker prints custom 1-inch to 4-inch wide signs and labels on demand, without the use of a personal computer.

Figure 1:
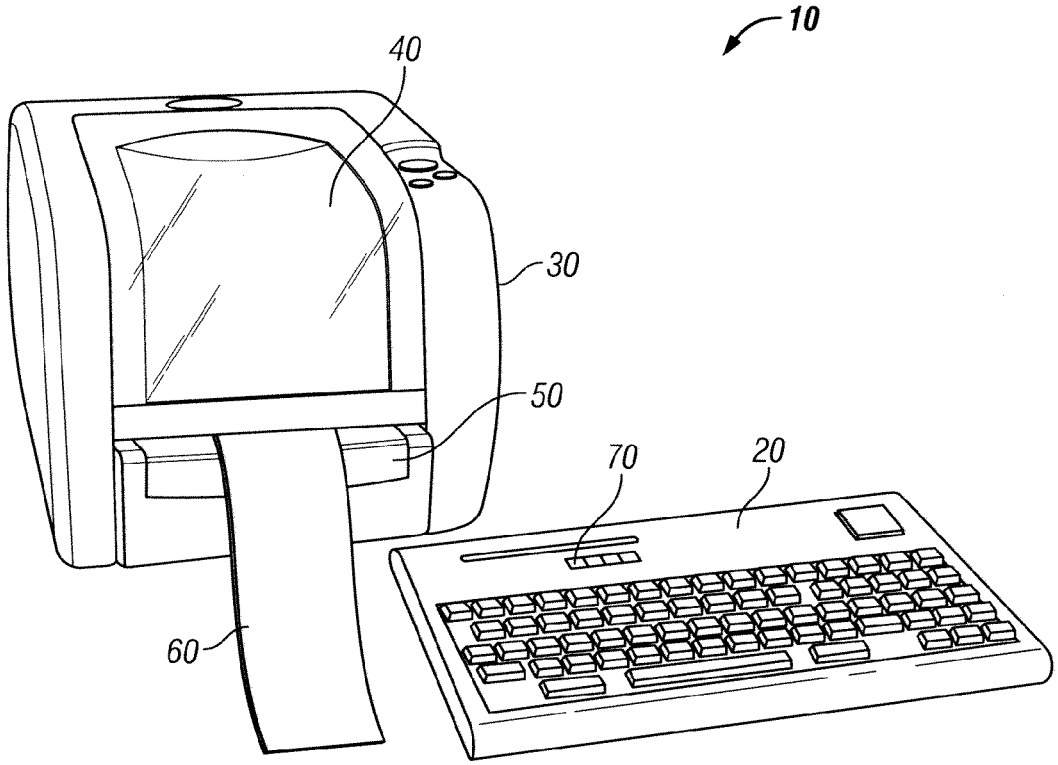
FIG. 1 is a perspective view illustrating a sign maker in accordance with an embodiment of the invention.

FIG. 1 illustrates a sign maker 10 in accordance with an embodiment of the invention. In particular, the sign maker 10 comprises a keyboard 20 connected to a sign maker printer 30, e.g., via a USB cable. In operation, the printer 30 employs a thermal printer engine to transfer ink from a thermal transfer roll to a continuous roll of media 40 that is cut (using cutter 50) at the completion of the printing to produce sign/label 60. As stated, the sign maker 10 produces signs and labels without the use of a personal computer. The sign maker 10 may further comprise a power supply such as a portable battery pack, a power cord, a media spindle with guides for supporting and guiding the media roll, and one or more ink take-up spindles. In certain embodiments, the sign maker 10 has no boot/loading time such that it is ready to use the instant it is turned on.

In accordance with embodiments of the invention, the sign maker 10 includes a series of user selectable templates containing algorithms. Each template comprises a centering algorithm stored on a non-transitory computer readable medium having computer executable program ode embodied thereon, the computer executable program code configured to calculate a length of the media and center the printed characters on the media based upon the user input. The templates are selected using the keyboard 20 in order to selectively control the operation of the printer 30 and cutter 50. These templates can be used to determine a suitable length and width of the sign/label 60, determine a suitable font size, determine when the cutter 50 cuts the continuous roll of media 40, and center the characters on the cut label.

The templates of the invention may be navigated using the arrow keys on the keyboard 20. Once a suitable template is selected, a simple menu guides the user through the process of entering in the variable information to create the sign/label 60. An LCD screen 70 is provided on the keyboard 20 for users to view the variable template prompts and observe the text as they type. In various embodiments, text is centered justified and cut proportionally on every label. The sign maker templates include, but are not limited to: (i) 1-line to 5-line horizontal (which is actually 24 different types of signs); (ii) 1-line vertical; (iii) 2-line header horizontal; (iv) header template; (v) arc flash; (vi) wire wrap; (vii) barcode; and (viii) pipe marking.

The continuous roll of media 40 may comprise any suitable type of media, including, but not limited to: (i) premium vinyl media, (ii) engineering grades reflective media, (iii) metallic media, (iv) fluorescent media, (v) magnetic media, and (vi) phosphorescent media.

The keyboard 20 includes a processor that runs hardware and software allowing the keyboard 20 to receive user instructions by way of the user selectable templates and communicate these instructions to the printer 30. The printer 30 also includes a processor that runs hardware and software allowing the printer 30 to receive and process the instructions from the keyboard 20 and control the operation of the printer 30 and cutter 50. More particularly, the processor includes a non-transitory computer readable medium having computer executable program code embodied thereon, the computer executable program code configured to cause the printer 30 to receive and process information from the keyboard 20 and templates, and control the function of the printer 30 and cutter 50 in order to produce various different signs and labels.

Figure 2:
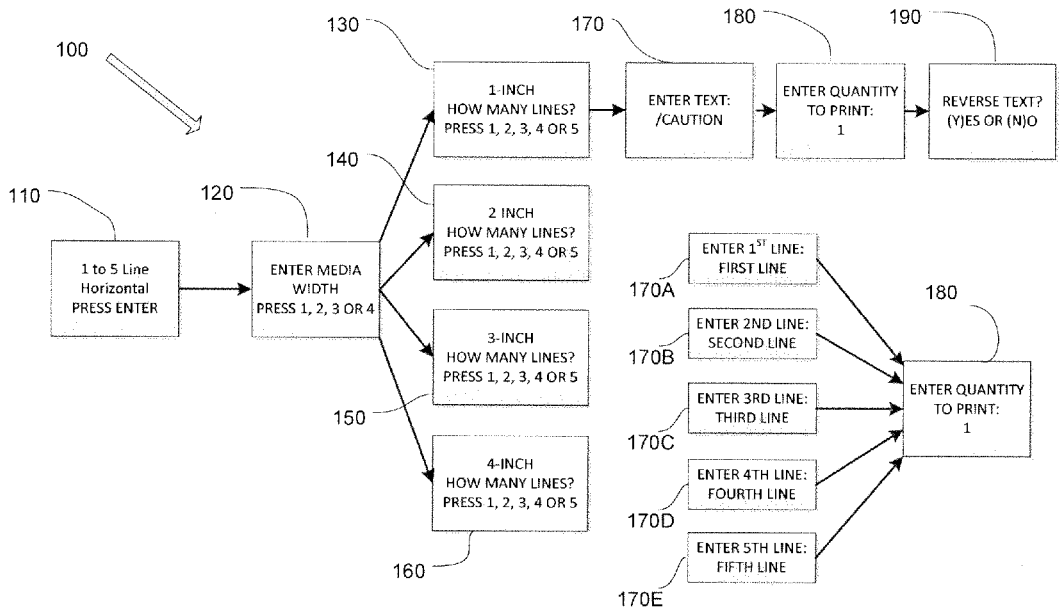
FIG. 2 is a flowchart illustrating a method for centering the characters of a 1-line to 5-line horizontal sign/label, in accordance with an embodiment of the invention.

FIG. 2 is a flowchart illustrating a method 100 for centering the characters of a 1-line to 5-line horizontal sign/label 60 using a template comprising a centering algorithm. Specifically, the method 100 entails determining the length of the sign/label 60 by the longest line in terms of pixel width and then using this information to cut the sign/label at an appropriate position using the cutter 50. According to the method 100, operation 110 involves the user selecting a template to print a sign/label 60 having a horizontal configuration. In the illustrated embodiment, the sign/label 60 may contain between one and five lines. Next, operation 120 entails the user entering the width of the media. This operation 120 comprises the user entering a number between one and four corresponding to a media width of 1-inch, 2-inch, 3-inch, or 4-inch, respectively. Subsequently, operations 130, 140, 150, 160 comprise the user entering the number of (horizontal) lines to be printed on the 1-inch, 2-inch, 3-inch, or 4-inch label 60, respectively.

With continued reference to FIG. 2, operation 170 entails entering the desired text for each line. Specifically, operation 170A comprises entering the first line of the sign/label 60: "CAUTION." In addition, depending on the number of lines previously selected, operation 170 may further comprise entering the second line of the sign/label 60 (operation 170B), entering the third line of the sign/label 60 (operation 170C), entering the fourth line of the sign/label 60 (operation 170D), and entering the fifth line of the sign/label 60 (operation 170E). Next, operation 180 involves entering the quantity of labels to print. Operation 190 entails the user entering a "Y" to indicate that the text on the sign/label 60 should be reversed, or an "N" to indicate that the text on the sign/label 60 should not be reversed. Reversing the text causes the sign or label to be printed as a negative image wherein the colors are inverted. The template then: (i) calculates the length of the horizontal sign/label 60 based upon the longest line among the one or more lines of text/symbols in terms of pixel width, (ii) causes the printer to print the sign/label 60 according to the text/symbols inputted by the user, and (iii) causes the cutter 50 to cut the label to the calculated length.

Figure 3:
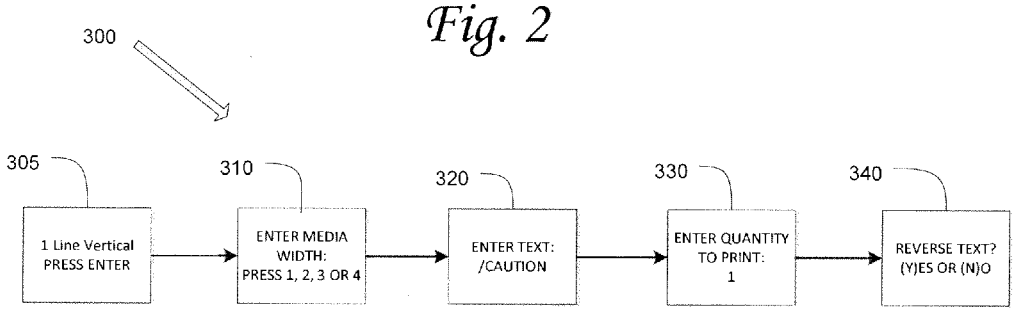
FIG. 3 is a flowchart illustrating a method 300 for centering the characters of a 1-line vertical sign/label, in accordance with an embodiment of the invention.

FIG. 3 is a flowchart illustrating a method 300 for centering the characters of a 1-line vertical sign/label 60 using a template comprising a centering algorithm. Specifically, the method 300 entails determining the length of the 1-line sign/label 60 by the amount of characters (i.e., text and/or symbols) inputted by the user as well as the text/symbol size inputted by the user, and then uses this information to cut the sign/label at an appropriate position using the cutter 50. According to the method 300, operation 305 involves the user selecting to print a sign/label 60 having a vertical configuration. Next, operation 310 entails the user entering the width of the media. This operation 310 comprises the user entering a number between one and four corresponding to a media width of 1-inch, 2-inch, 3-inch, or 4-inch, respectively.

With further reference to FIG. 3, operation 320 entails entering the appropriate text. Next, operation 330 involves entering the quantity of labels to print. Operation 330 entails the user entering a "Y" to indicate that the text on the sign/label 60 should be reversed, or an "N" to indicate that the text on the sign/label 60 should not be reversed. As stated above, reversing the text causes the sign or label to be printed as a negative image wherein the colors are inverted. The template then: (i) calculates the length of the 1-line vertical sign/label 60 based upon the pixel length of the line, (ii) causes the printer to print the sign/label 60 according to the text/symbols inputted by the user, and (iii) causes the cutter 50 to cut the label to the calculated length.

Figure 4:
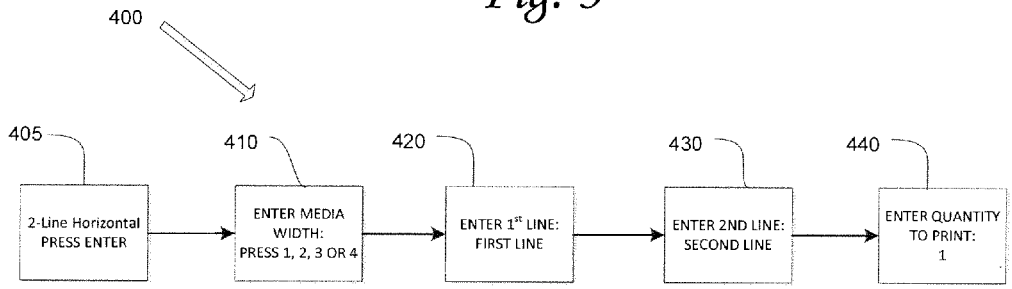
FIG. 4 is a flowchart illustrating a method for centering the characters of a 2-line horizontal sign/label, in accordance with an embodiment of the invention.

FIG. 4 is a flowchart illustrating a method 400 for centering the characters of a 2-line horizontal sign/label 60 using a template comprising a centering algorithm. Specifically, the method 400 entails determining the length of the 2-line sign/label 60 by the longest line between the first and second lines with respect to pixel width. The template utilizes this information to cause the sign/label to be cut using the cutter 50 such that the printed characters are centered or otherwise positioned in a desired location on the finished sign/label 50.

According to the method 400, operation 405 involves the user selecting to print a 2-line sign/label 60 having a horizontal configuration. Next, operation 410 entails the user entering the width of the media. This operation 410 comprises the user entering a number between one and four corresponding to a media width of 1-inch, 2-inch, 3-inch, or 4-inch, respectively.

With continued reference to FIG. 4, operation 420 entails the user entering the appropriate first line of text. Next, operation 430 comprises the user entering the appropriate second line of text. Operation 440 involves entering the quantity of labels to print. The template then: (i) calculates the length of the 2-line horizontal sign/label 60 based upon the longest line between the two lines of text/symbols in terms of pixel width, (ii) causes the printer to print the sign/label 60 according to the text/symbols inputted by the user, and (iii) causes the cutter 50 to cut the label to the calculated length.

Figure 5:
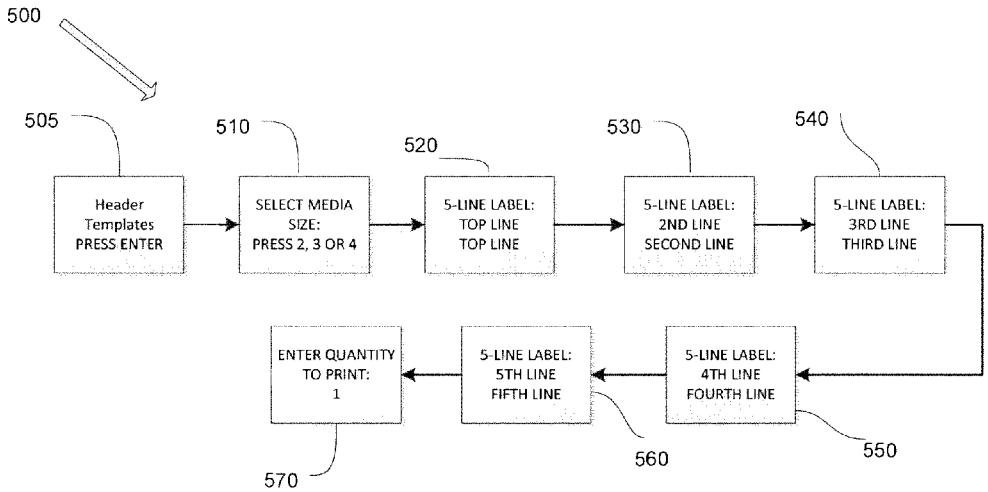
FIG. 5 is a flowchart illustrating a method for centering the characters of a 5-line horizontal sign/label, in accordance with an embodiment of the invention.

FIG. 5 is a flowchart illustrating a method 500 for centering the characters of a 5-line horizontal sign/label 60 having a header using a template comprising a centering algorithm. This method 500 allows the user to create a sign/label having a header with a first font size, wherein the second to fifth lines are printed in a second font size that is smaller than the first (header) font size. By way of example, the header template may be employed to create caution labels, warning labels, notice labels and safety labels. The method 500 entails determining the length of the sign/label 60 by the longest line among the lines of text/symbols in terms of pixel width. The template utilizes this information to cause the sign/label to be cut according to the longest line using the cutter 50. According to the method 500, operation 505 involves the user selecting a header template. Next, operation 510 entails the user selecting the media size. In the illustrated embodiment, the user has the option of selecting a number between two and four corresponding to a 2-inch, 3-inch, or 4-inch media width, respectively.

With further reference to FIG. 5, operation 520 entails the user entering the appropriate top line of text for the 5-line sign/label. Next, operation 530 comprises the user entering the desired second line of text, while operation 540 involves the user entering the desired third line of text. Likewise, operation 550 comprises the user entering the desired fourth line of text, whereas operation 560 involves the user entering the desired fifth line of text. Operation 570 involves the user entering the quantity of labels to print. The template then: (i) calculates the length of the 5-line sign/label 60 based upon the longest line among the five lines of text/symbols in terms of pixel width, (ii) causes the printer to print the sign/label 60 according to the text/symbols inputted by the user, and (iii) causes the cutter 50 to cut the label to the calculated length.

Figure 6:
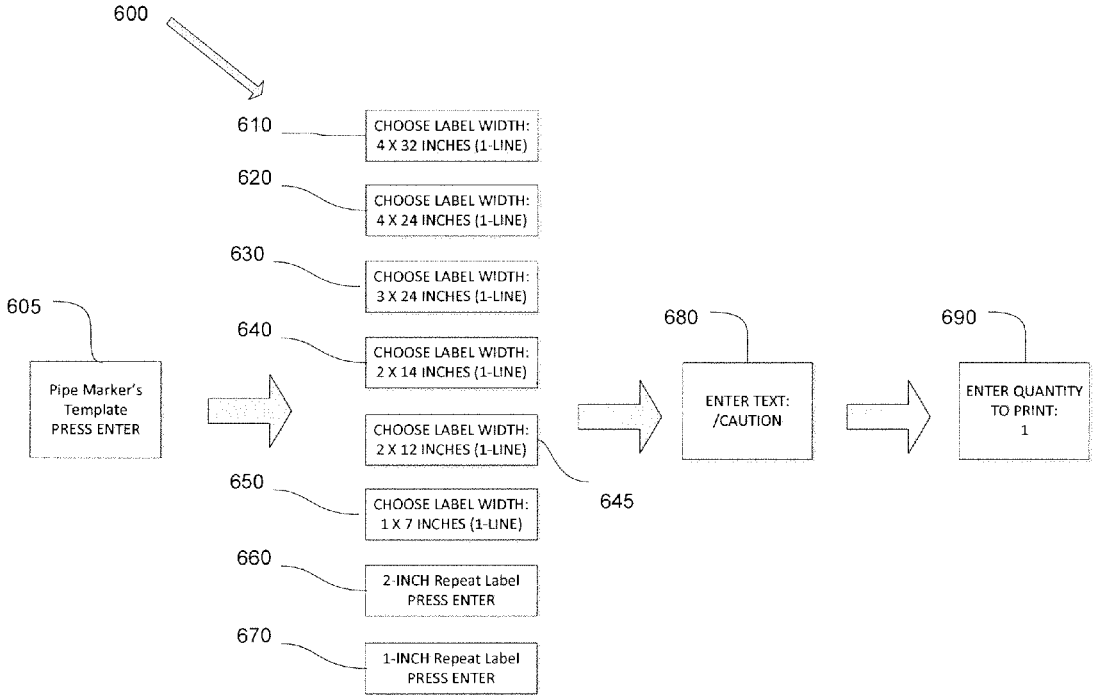
FIG. 6 is a flowchart illustrating a method for centering the characters of a 1-line pipe marker's label, in accordance with an embodiment of the invention.

FIG. 6 is a flowchart illustrating a method 600 for centering the characters of a 1-line pipe marker's label 60 using a template comprising a centering algorithm. Specifically, the method 600 entails determining the length of the 1-line pipe marker's 60 by the amount of characters (i.e., text and/or symbols) inputted by the user as well as the text/symbol size inputted by the user, and then uses this information to cut the label at an appropriate position using the cutter 50. According to the method 600, operation 605 involves the user selecting a pipe marker's template. The pipe marker's template may be utilized to create labels that meet ANSI/ASMI letter height standards and tape lengths. The user then selects among one or more template options. In the illustrated embodiment, the user may select a 4×32 inch label (operation 610), a 4×24 inch label (operation 620), a 3×24 inch label (operation 630), a 2×14 inch label (operation 640), a 2×12 inch label (operation 645), a 1×7 inch label (operation 650), a 2-inch repeat label (operation 660), or a 1-inch repeat label (operation 670).

With further reference to FIG. 6, operation 680 entails entering the appropriate text for the 1-line pipe marker's label. Next, operation 690 involves entering the quantity of labels to print. The template then: (i) calculates the length of the 1-line pipe marker's label based upon the pixel length of the line, (ii) causes the printer to print the label 60 according to the text/symbols inputted by the user, and (iii) causes the cutter 50 to cut the label to the calculated length.

Further embodiments of the invention are directed toward arc flash templates, barcode templates, and wire wrap templates. In particular, arc flash templates meet the following NEC electrical code: "Arc flash hazard warnings are required to reduce the occurrences of serious injury or death due to arcing faults to those who work on or near energized electrical equipment." Barcode templates include a basic inventory/asset and a bin/shelf barcode template utilizing the CODE39 symbology. Wire wrap templates provide an easy means for identifying wires and cables with an identification number.

According to some embodiments of the invention, the sign maker 10 may include additional utilities including, but not limited to: (i) a calculator; (ii) a unit of length converter; (iii) a printable ruler (e.g., up to 36"), and (iv) a time/date stamp label with or without a barcode. These utilities provide tools to help users accomplish tasks, other than labeling responsibilities.

Another embodiment of the invention is directed toward a sign maker that prints 4-inch to 9-inch wide labels and signs.

Further embodiments of the invention are directed toward a sign maker that prints ¼-inch to 2-inch wide labels and signs.

Additional embodiments of the invention are directed toward a sign maker that prints up to 6-inch labels and signs.

Further embodiments of the invention are directed toward a sign maker that prints 1-inch to 4-inch media. Such embodiments may include a heavy duty cutter.

Additional embodiments of the invention are directed toward a sign maker that prints 4-inch to 8-inch media. Such embodiments may include a heavy duty cutter.

As used herein, the term "set" may refer to any collection of elements, whether finite or infinite. The term "subset" may refer to any collection of elements, wherein the elements are taken from a parent set; a subset may be the entire parent set. The term "proper subset" refers to a subset containing fewer elements than the parent set. The term "sequence" may refer to an ordered set or subset. The terms "less than," "less than or equal to," "greater than," and "greater than or equal to," may be used herein to describe the relations between various objects or members of ordered sets or sequences; these terms will be understood to refer to any appropriate ordering relation applicable to the objects being ordered.

The term "tool" can be used to refer to any apparatus configured to perform a recited function. For example, tools can include a collection of one or more modules and can also be comprised of hardware, software or a combination thereof. Thus, for example, a tool can be a collection of one or more software modules, hardware modules, software/hardware modules or any combination or permutation thereof. As another example, a tool can be a computing device or other appliance on which software runs or in which hardware is implemented.

As used herein, the term "module" might describe a given unit of functionality that can be performed in accordance with one or more embodiments of the present invention. As used herein, a module might be implemented utilizing any form of hardware, software, or a combination thereof. For example, one or more processors, controllers, ASICs, PLAs, PALs, CPLDs, FPGAs, logical components, software routines or other mechanisms might be implemented to make up a module. In implementation, the various modules described herein might be implemented as discrete modules or the functions and features described can be shared in part or in total among one or more modules. In other words, as would be apparent to one of ordinary skill in the art after reading this description, the various features and functionality described herein may be implemented in any given application and can be implemented in one or more separate or shared modules in various combinations and permutations. Even though various features or elements of functionality may be individually described or claimed as separate modules, one of ordinary skill in the art will understand that these features and functionality can be shared among one or more common software and hardware elements, and such description shall not require or imply that separate hardware or software components are used to implement such features or functionality.

Where components or modules of the invention are implemented in whole or in part using software, in one embodiment, these software elements can be implemented to operate with a computing or processing module capable of carrying out the functionality described with respect thereto. One such example computing module is shown in FIG. 4. Various embodiments are described in terms of this example—computing module 1000. After reading this description, it will become apparent to a person skilled in the relevant art how to implement the invention using other computing modules or architectures.

Figure 7:
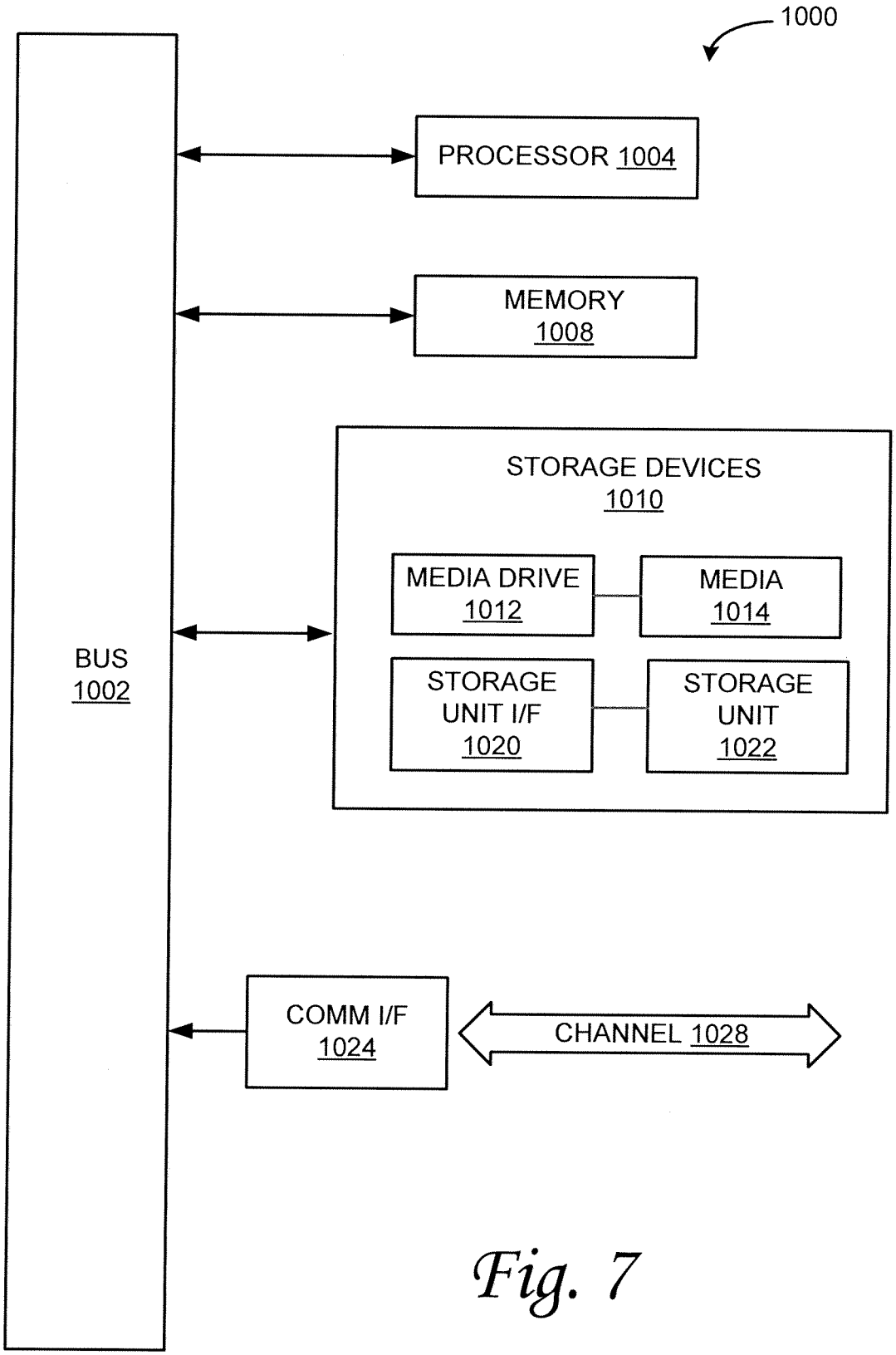
FIG. 7 is a diagram illustrating an example computing module for implementing various embodiments of the invention.

Referring now to FIG. 7, computing module 1000 may represent, for example, computing or processing capabilities found within desktop, laptop and notebook computers; handheld computing devices (PDA's, smart phones, cell phones, palmtops, etc.); mainframes, supercomputers, workstations or servers; or any other type of special-purpose or general-purpose computing devices as may be desirable or appropriate for a given application or environment. Computing module 1000 might also represent computing capabilities embedded within or otherwise available to a given device. For example, a computing module might be found in other electronic devices such as, for example, printers, keyboards, digital cameras, navigation systems, cellular telephones, portable computing devices, modems, routers. WAPs, terminals and other electronic devices that might include some form of processing capability.

Computing module 1000 might include, for example, one or more processors, controllers, control modules, or other processing devices, such as a processor 1004. Processor 1004 might be implemented using a general-purpose or special-purpose processing engine such as, for example, a microprocessor, controller, or other control logic. In the illustrated example, processor 1004 is connected to a bus 1003, although any communication medium can be used to facilitate interaction with other components of computing module 1000 or to communicate externally.

Computing module 1000 might also include one or more memory modules, simply referred to herein as main memory 1008. For example, preferably random access memory (RAM) or other dynamic memory, might be used for storing information and instructions to be executed by processor 1004. Main memory 1008 might also be used for storing temporary variables or other intermediate information during execution of instructions to be executed by processor 1004. Computing module 1000 might likewise include a read only memory ("ROM") or other static storage device coupled to bus 1003 for storing static information and instructions for processor 1004.

The computing module 1000 might also include one or more various forms of information storage mechanism 1010, which might include, for example, a media drive 1012 and a storage unit interface 1020. The media drive 1012 might include a drive or other mechanism to support fixed or removable storage media 1014. For example, a hard disk drive, a floppy disk drive, a magnetic tape drive, an optical disk drive, a CD, DVD or Blu-ray drive (R or RW), or other removable or fixed media drive might be provided. Accordingly, storage media 1014 might include, for example, a hard disk, a floppy disk, magnetic tape, cartridge, optical disk, a CD, DVD or Blu-ray, or other fixed or removable medium that is read by, written to or accessed by media drive 1012. As these examples illustrate, the storage media 1014 can include a computer usable storage medium having stored therein computer software or data.

In alternative embodiments, information storage mechanism 1010 might include other similar instrumentalities for allowing computer programs or other instructions or data to be loaded into computing module 1000. Such instrumentalities might include, for example, a fixed or removable storage unit 1022 and an interface 1020. Examples of such storage units 1022 and interfaces 1020 can include a program cartridge and cartridge interface, a removable memory (for example, a flash memory or other removable memory module) and memory slot, a PCMCIA slot and card, and other fixed or removable storage units 1022 and interfaces 1020 that allow software and data to be transferred from the storage unit 1022 to computing module 1000.

Computing module 1000 might also include a communications interface 1024. Communications interface 1024 might be used to allow software and data to be transferred between computing module 1000 and external devices. Examples of communications interface 1024 might include a modem or softmodem, a network interface (such as an Ethernet, network interface card, WiMedia, IEEE 802.XX or other interface), a communications port (such as for example, a USB port, IR port, RS232 port Bluetooth® interface, or other port), or other communications interface. Software and data transferred via communications interface 1024 might typically be carried on signals, which can be electronic, electromagnetic (which includes optical) or other signals capable of being exchanged by a given communications interface 1024. These signals might be provided to communications interface 1024 via a channel 1028. This channel 1028 might carry signals and might be implemented using a wired or wireless communication medium. Some examples of a channel might include a phone line, a cellular link, an RF link, an optical link, a network interface, a local or wide area network, and other wired or wireless communications channels.

In this document, the terms "computer program medium" and "computer usable medium" are used to generally refer to media such as, for example, memory 1008, storage unit 1020, media 1014, and channel 1028. These and other various forms of computer program media or computer usable media may be involved in carrying one or more sequences of one or more instructions to a processing device for execution. Such instructions embodied on the medium, are generally referred to as "computer program code" or a "computer program product" (which may be grouped in the form of computer programs or other groupings). When executed, such instructions might enable the computing module 1000 to perform features or functions of the present invention as discussed herein.

While various embodiments of the present invention have been described above, it should be understood that they have been presented by way of example only, and not of limitation.

Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the invention is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations, to one or more of the other embodiments of the invention, whether or not such embodiments are described and whether or not such features are presented as being a part of a described embodiment. Thus, the breadth and scope of the present invention should not be limited by any of the above-described exemplary embodiments.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, block diagrams and their accompanying description should not be construed as mandating a particular architecture or configuration.

What is claimed is:

1. A sign maker for printing signs and labels on a continuous roll of media without the use of a personal computer, the sign maker comprising:

a keyboard for receiving user input;

a printer for printing characters on the media;

a cutter for cutting the media to a calculated length; and a user selectable template containing a centering algorithm stored on a non-transitory computer readable medium having computer executable program code embodied thereon, the computer executable program code configured to calculate a length of the media and center the printed characters on the media based upon the user input.

2. The sign maker of claim 1, wherein the printer employs a thermal printer engine to transfer ink from a thermal transfer roll to the media, and wherein the media is cut using the cutter at the completion of the printing to produce a finished sign or label.

3. The sign maker of claim 1, further comprising a portable battery pack for powering the sign maker.

4. The sign maker of claim 1, wherein the sign maker has no boot/loading time such that it is ready to use immediately upon being turned on.

5. The sign maker of claim 1, wherein the user input includes a desired template selected from the group consisting of: a horizontal template, a vertical template, a header template, an arc flash template, a wire wrap template, a barcode template, and a pipe marking template.

6. The sign maker of claim 1, wherein the user input includes a media width, a number of lines of characters, a sequence of characters for each line, and a quantity of signs or labels to print.

7. The sign maker of claim 1, wherein the keyboard includes an LCD screen for users to view a selection of available templates and user inputted text.

8. The sign maker of claim 1, wherein the characters are centered justified and cut proportionally on the finished sign or label.

9. The sign maker of claim 1, wherein the user input includes one or more lines of characters, and wherein the length of the cut media is calculated based upon a pixel width of a longest line of characters.

10. A user selectable template containing a centering algorithm stored on a non-transitory computer readable medium having computer executable program code embodied thereon, the computer executable program code configured to receive user input from a keyboard and control the operation of a printer and a cutter without the use of a personal computer, by performing the steps of:

receiving user input from the keyboard including a desired template, a media width, a number of lines of characters, a sequence of characters for each line, and a quantity of signs or labels to print, calculating a length of the media based upon a pixel width of a longest line of characters;

controlling the printer to print the characters on the media according sequence of characters inputted by the user; and controlling the cutter to cut the media to the calculated length.

11. The computer readable medium of claim 10, wherein the template receives further user input regarding whether the characters on the media are to be reverse printed.

12. The computer readable medium of claim 10, wherein the printer employs a thermal printer engine to transfer ink from a thermal transfer roll to the media.

13. The computer readable medium of claim 11, wherein the media is cut using the cutter at the completion of the printing to produce a finished sign or label.

14. The computer readable medium of claim 10, wherein the keyboard and printer are powered using a portable battery pack.

15. The computer readable medium of claim 10, wherein the desired template is selected from the group consisting of: a horizontal template, a vertical template, a header template, an arc flash template, a wire wrap template, a barcode template, and a pipe marking template.

16. The computer readable medium of claim 10, wherein the keyboard includes an LCD screen for users to view a selection of available templates and user inputted text.

17. The computer readable medium of claim 10, wherein the characters are centered justified and cut proportionally on the finished sign or label.

* * * * *